US007121907B2

(12) United States Patent
Tateishi et al.

(10) Patent No.: US 7,121,907 B2
(45) Date of Patent: Oct. 17, 2006

(54) ANODE MOUNTING STRUCTURE FOR OUTBOARD MOTOR ENGINE

(75) Inventors: Yuji Tateishi, Hamamatsu (JP); Toshiyuki Mizushima, Hamamatsu (JP); Masahiro Mizuno, Hamamatsu (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 148 days.

(21) Appl. No.: 10/985,445

(22) Filed: Nov. 11, 2004

(65) Prior Publication Data

US 2005/0118901 A1 Jun. 2, 2005

(30) Foreign Application Priority Data

Nov. 11, 2003 (JP) ..... 2003-380941
Feb. 9, 2004 (JP) ..... 2004-032526

(51) Int. Cl.
*B63H 21/10* (2006.01)
*B63H 21/14* (2006.01)

(52) U.S. Cl. ..... 440/80 R; 440/88 C

(58) Field of Classification Search ..... 440/88 R, 440/88 C

See application file for complete search history.

(56) References Cited

U.S. PATENT DOCUMENTS 6,319,080 B1 11/2001 Watanabe et al.

FOREIGN PATENT DOCUMENTS

| | | |
|---|---|---|
| JP | 06-011042 | 1/1994 |
| JP | 10-236390 | 9/1998 |
| JP | 11-011390 | 1/1999 |

*Primary Examiner*—Jesus D. Sotelo
(74) *Attorney, Agent, or Firm*—Knobbe, Martens, Olson & Bear, LLP

(57) ABSTRACT

An anode mounting structure for a marine engine including a metallic gasket mounted on the mating face between components of the engine, such as a cylinder head and a cylinder body, which form a coolant passage extending across the components, and an anode for corrosion prevention facing the coolant passage, in which the anode is attached to the gasket.

14 Claims, 6 Drawing Sheets

ANODE MOUNTING STRUCTURE FOR OUTBOARD MOTOR ENGINE

PRIORITY INFORMATION

The present application is based on and claims priority under 35 U.S.C. § 119 to Japanese Patent Application No. 2004-032526, filed on Feb. 9, 2004, and Japanese Patent Application No. 2003-380941, filed on Nov. 11, 2003 the entire contents of both of which are expressly incorporated by reference herein.

BACKGROUND OF THE INVENTIONS

1. Field of the Inventions

The present inventions relate to a mounting structure of an anode for corrosion prevention (sacrificial anode) for a marine engine.

2. Description of the Related Art

When an outboard motor is employed on the sea, its engine, which may be made of an aluminum alloy, is corroded by sea water used as coolant for the engine. To cope with this problem, anodes made of a metal such as zinc, with a lower polarization potential than an aluminum alloy, have been disposed in the coolant passages of such engines. As such, the anode acts as a sacrificial anode, thereby preventing the electrochemical reaction causing electrolytic corrosion of the engine. For example, see Japanese Patent Publication Nos. Hei 10-236390 and Hei 11-11390.

The electrolytic corrosion prevention effect of such anodes decreases with increasing distances from the mounting position of the anode. Thus, a satisfactory electrolytic corrosion prevention effect can be obtained only within a limited range, which can also vary depending on the material used for the sacrificial anode and the cross-sectional area of the coolant passage. Therefore, to achieve a satisfactory electrolytic corrosion prevention effect with an anode, multiple anodes are often attached throughout the coolant passage at given intervals. For example, some engines are constructed with anodes spaced apart by about 300 mm or less for a coolant jacket of an aluminum alloy, four-cylinder engine having a displacement of about 1800 cubic centimeters.

However, in such a conventional anode mounting structure, it is difficult in practice to attach anodes at given intervals inside a coolant jacket, which can have a complicated shape, such as those formed around the combustion chambers of en engine. Additionally, areas can be found at which no effect of the anodes is produced, thereby allowing the engine to corrode in those areas.

Additionally, in order to mount anodes to an engine body so as to be removable, leak-proof, and in communication with fluids in the cooling jacket, mounting seats are machined into the engine body. The seats are formed, for example, in the wall surface of the cylinder head or the cylinder body and the anodes are attached to the seat faces. However, such seats increase the size of the engine. Additionally, such machining and assembling can be time-consuming and thus can lower productivity.

Fixing the anode to the seats requires a reliable fastening method which withstands engine vibration in corrosive environments and which ensures an electrical connection. Thus, the seats are typically provided with machine threads so that the anodes can be secured with tight fitting bolts.

One alternative approach, described in Japanese Patent Publication No. Hei 6-11042, includes using a cylinder head gasket having an inner core with an electrolytic solution potential approximately equal to that of the cylinder head and the cylinder body. As such, the gasket can suppress the electrolytic corrosion of the engine. However, this gasket has a special and complicated structure of three layers, causing trouble in manufacturing.

SUMMARY OF THE INVENTION

An aspect of at least one of the inventions includes the realization that by mounting a sacrificial anode to a gasket, a satisfactory electrolytic corrosion prevention effect can be achieved with a simple construction and without increasing the engine size.

In accordance with one embodiment, an anode mounting structure for a marine engine comprises a metallic gasket configured to be mounted between components of the engine. The components of the engine are formed with a coolant passage extending across the components. An anode is configured to prevent corrosion of the engine and is disposed so as to face toward the coolant passage, wherein the anode is attached to the gasket.

In accordance with another embodiment, an anode mounting structure for a marine engine comprises a metallic gasket configured to be mounted between components of the engine. The components of the engine are formed with a coolant passage extending across the components. An anode is configured to prevent corrosion of the engine and is disposed so as to face toward the coolant passage. The mounting structure also includes means for attaching the anode to an exterior of the gasket.

In accordance with a further embodiment, a marine engine comprises an engine body, the engine body including a first portion having a first mating face and a second portion having a second mating face. The first and second portions are removeably connected to each other with the first and second mating faces facing each other. A gasket is disposed between the first and second mating faces. A cooling passage is defined by at least one of the first and second portions. At least one sacrificial anode is connected to an exterior of the gasket so as to be exposed to fluid in the coolant passage.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following Figures:

FIG. 6(*b*) is a partial sectional view of another exemplary mounting configuration for the anode.

FIG. 6(*c*) is a partial sectional view of an exemplary mounting configuration for the anode.

DETAILED DESCRIPTION OF THE PREFERRED EMBODIMENT

Figure 1:
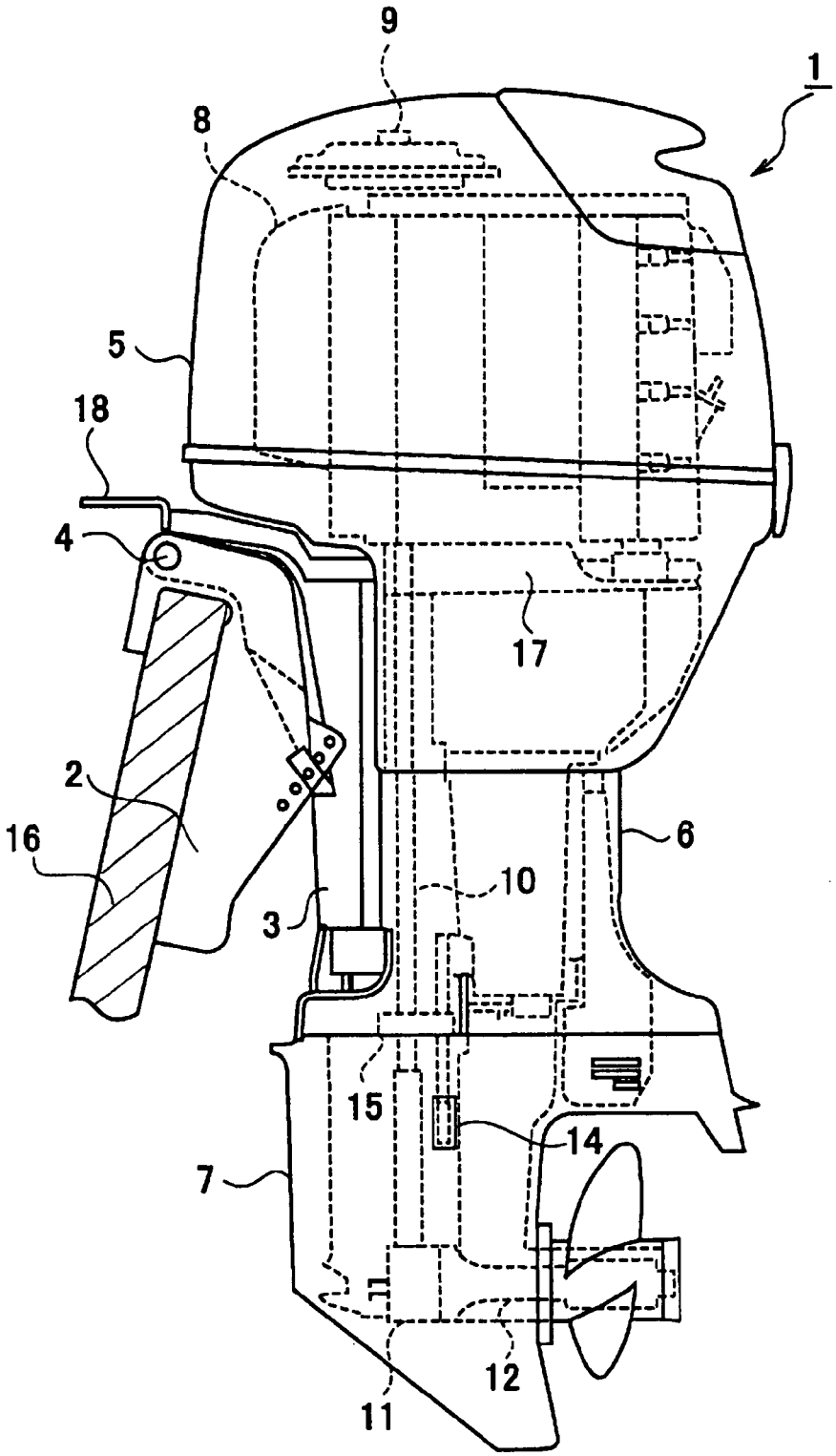
FIG. 1 is a side view of an outboard motor with certain internal components, such as an engine, illustrated in phantom line, and in which an anode constructed in accordance with an embodiment is disposed.

FIG. 1 is a side view of an outboard motor 1 to which an embodiment of the anode mounting structure is applied. The anode mounting structure has particular utility in the environment of use of outboard motors, and therefore is illustrated in connection with such a device. It is contemplated, however, that the anode mounting structure can be used with other types of vehicles as well, such as, for example, but without limitation, small jet boats and other vehicles exposed to marine environments.

The outboard motor 1 is attached to a transom plate 16 of a hull through a clamp bracket 2. The outboard motor 1 can be tilted about a tilt shaft 4, it can be raised upwardly at the time of rest, and its trim angle can be adjusted during running. The outboard motor 1 is also held by a swivel bracket 3. A handle is provided to allow a driver to rotate the outboard motor 1 about an approximately vertical swivel shaft (not shown) through a shift link 18 for the steering of the hull.

The outboard motor 1 is covered outside by a top cowling 5, an upper case 6 and a lower case 7. In the top cowling 5 an engine 8 is housed and mounted over an exhaust guide plate 17. The engine 8 is a water-cooled, four-cylinder, four-stroke engine. However, this is merely one type of engine that can be used. The engine 8 includes a vertically disposed crankshaft 9. A drive shaft 10 is connected to the lower end of the crankshaft 9.

The lower end of the drive shaft 10 is connected to a propeller shaft 12 through a forward/reverse shift mechanism 11. A water intake 14 for cooling purposes, opens in the side of the lower case 7. The sea water taken in from the water intake 14 is pressurized by a coolant pump 15 connected directly to the drive shaft 10 and sent to the engine 8 for cooling regions around combustion chambers and exhaust passages, and other portions.

Figure 2:
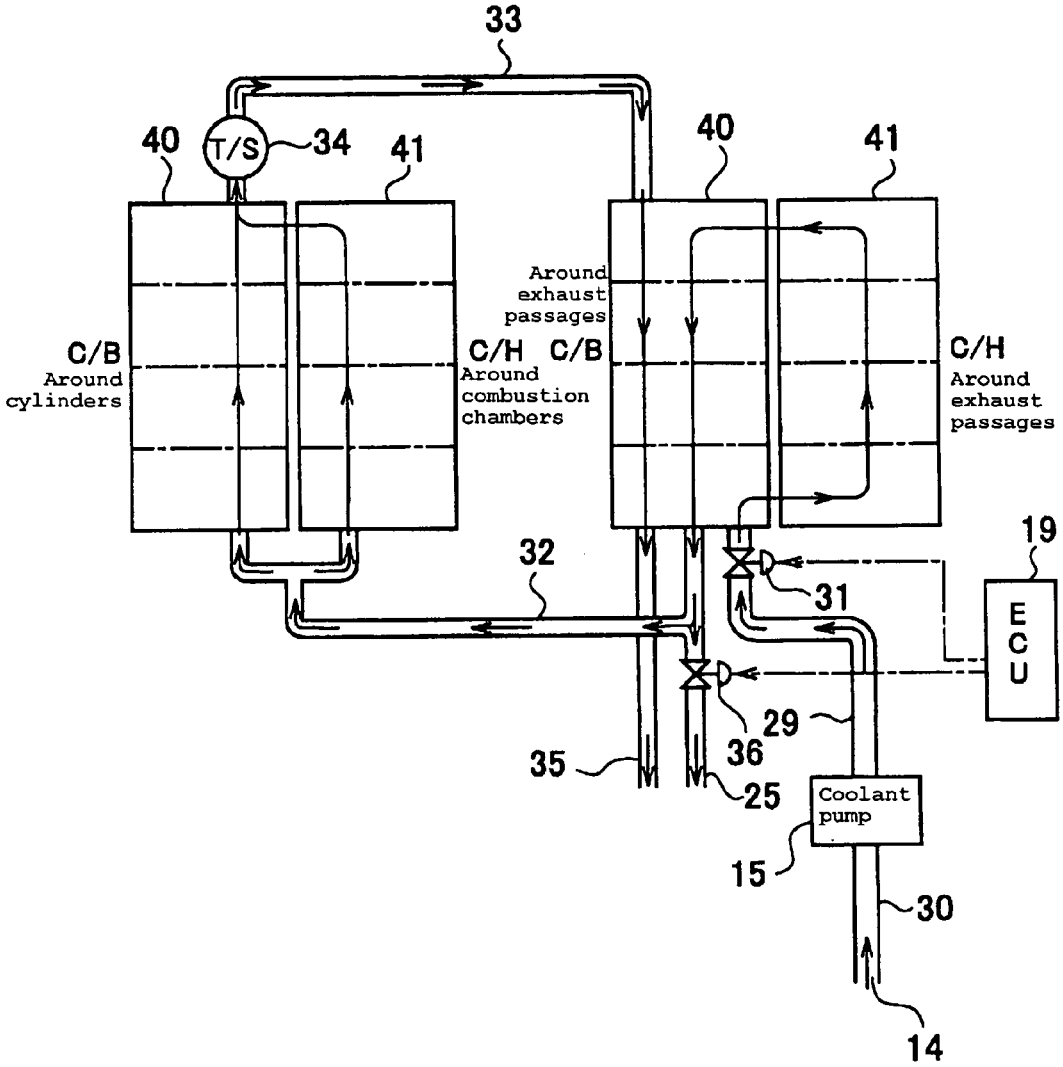
FIG. 2 is a schematic diagram of a cooling system of the outboard motor of FIG. 1.

FIG. 2 is a system diagram of coolant piping of the outboard motor engine. In FIG. 2, reference numeral 30 designates a coolant suction pipe connecting the water intake 14 opening in the lower case 7 and the suction side of the coolant pump 15. A coolant feed pipe 29 connected to the delivery side of the coolant pump 15 is connected to the inlet of a coolant passage around exhaust passages of a cylinder body 40 of the engine, and a solenoid valve 31 is provided halfway therein, although other locations for the valve 31 can also be used.

The coolant passage runs around exhaust passages of a cylinder head 41 and the exhaust passages of the cylinder body 40 from the inlet and is connected to a coolant passage 32 at the outlet of the coolant passage around the exhaust passages of the cylinder body 40. The coolant passage 32 includes a coolant draining passage 25 branched off near the outlet through a solenoid valve 36. Additionally, the coolant passage 32 is divided two passages on the downstream side from the branch point, one of which is connected to the inlet of a coolant passage around the combustion chambers of the cylinder head 41 and the other of which is connected to the inlet of a coolant passage around the cylinders of the cylinder body 40. These coolant passages around the cylinders of the cylinder body 40 and around the combustion chambers of the cylinder head 41 join at their outlets to be connected to the inlet of the coolant passage around the exhaust passages of the cylinder body 40 through a coolant passage 33.

A thermostat valve 34 is provided in the middle of the coolant passage 33, although other positions can also be used. To the outlet of the coolant passage around the exhaust passages of the cylinder body 40 is connected a coolant drain passage 35. The solenoid valves 31, 36 are connected to an ECU 19 to control the amount of coolant discharged into the drain passage 35.

Figure 3:
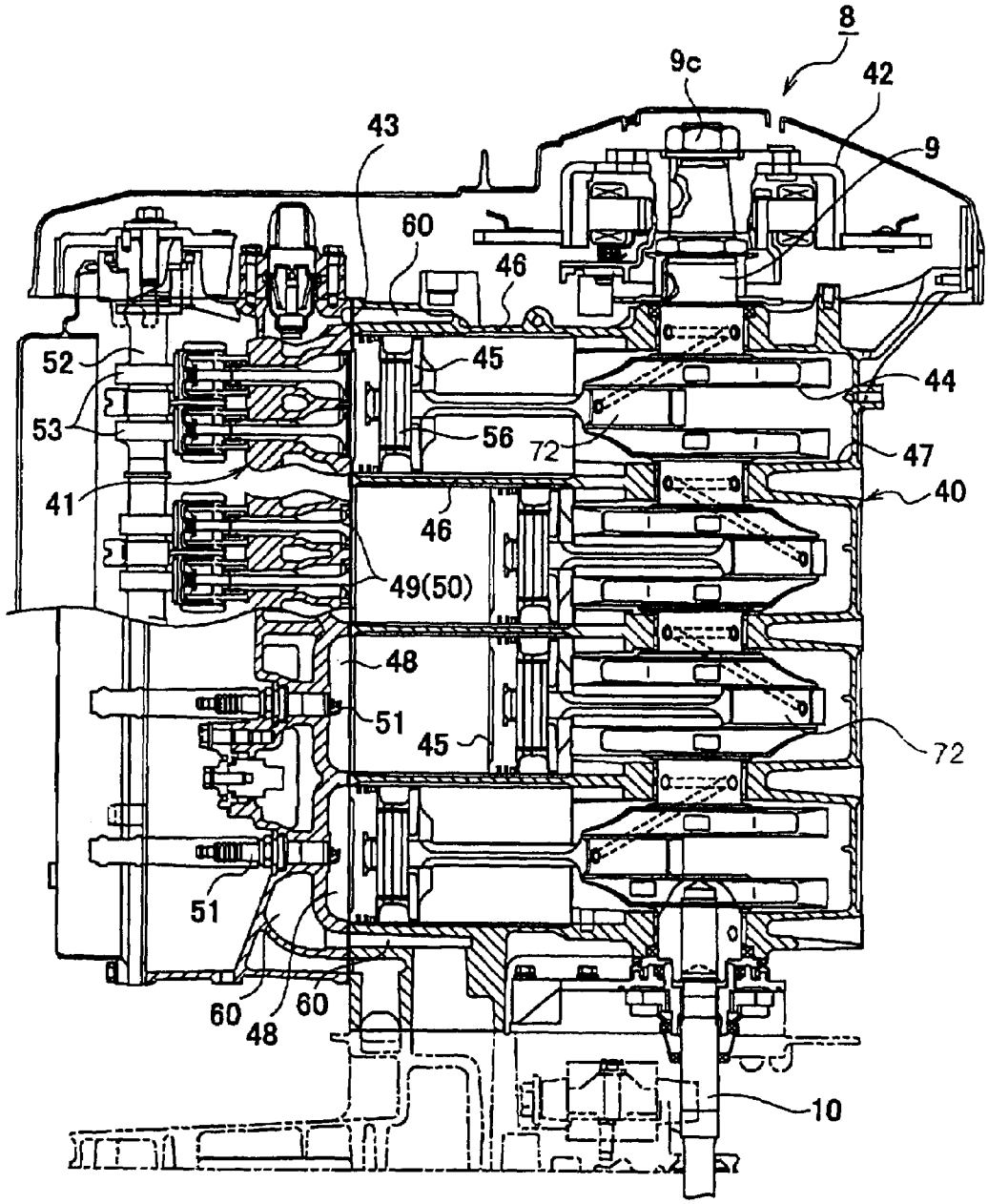
FIG. 3 is a sectional view of the engine of the outboard motor of FIG. 1, taken along its crankshaft, into which the anode is applied.
Figure 4:
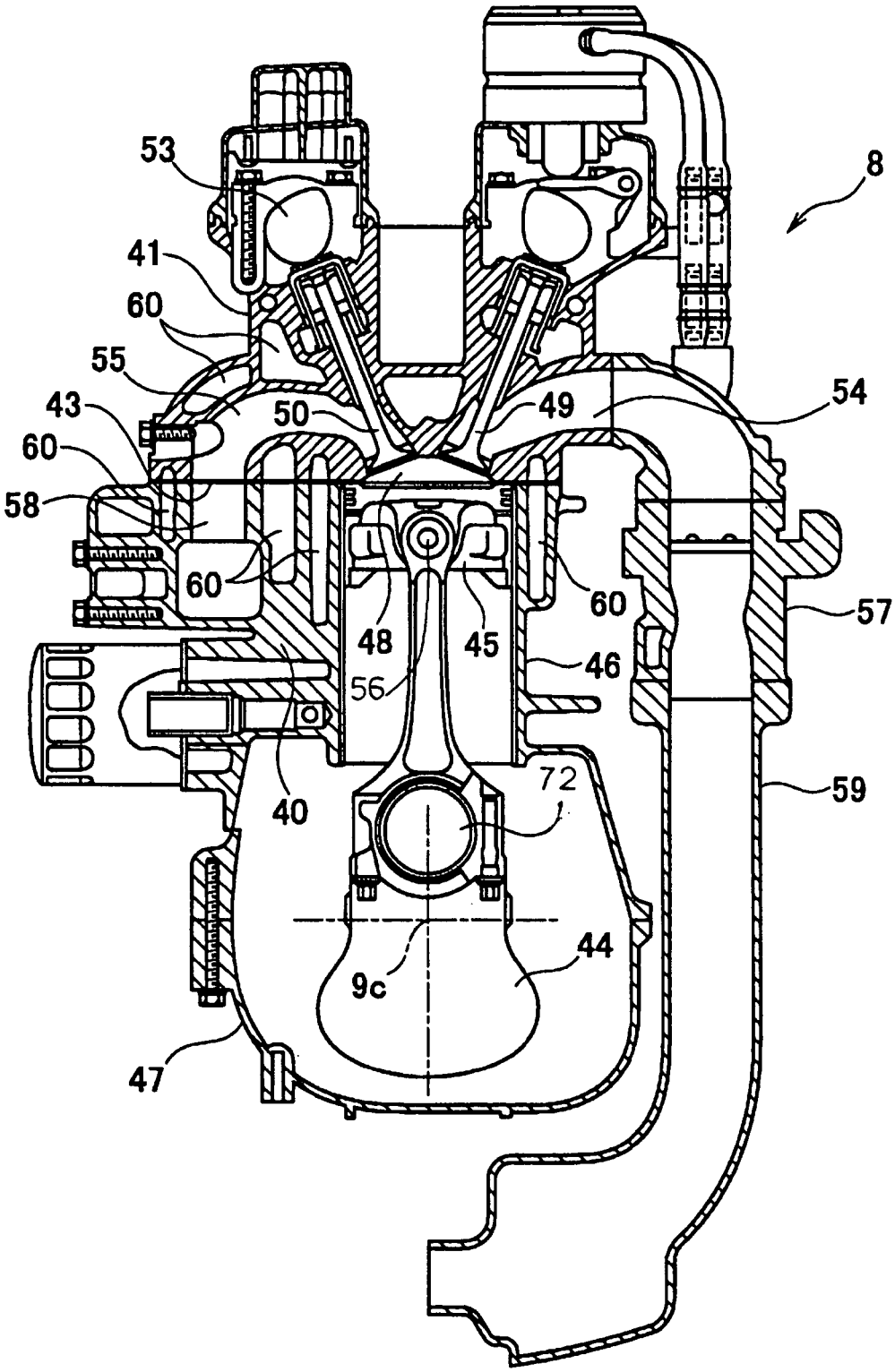
FIG. 4 is a sectional view of the engine of FIG. 3, taken in the direction perpendicular to the crankshaft.

FIGS. 3 and 4 are sectional views of the engine 8, taken along the crankshaft and taken in the direction perpendicular to the crankshaft, respectively. The engine 8 is a water-cooled, four-stroke, four-cylinder engine.

With continued reference to FIGS. 3 and 4, the crankshaft 9, extending vertically through the engine 8, connects crank webs 44 of four cylinders within the engine 8. A flywheel 42 constituting a generator is mounted to the upper end of the crankshaft 9. A drive shaft 10 is connected to the lower end of the crankshaft 9. Reference numeral 9*c* designates the axis of the crankshaft.

The engine 8 includes a cylinder body 40 and a cylinder head 41 of aluminum-alloy castings joined together, with a gasket 43 mounted on the mating face between them. Preferably, the gasket 43 is metallic. The cylinder body 40 includes cylinders 46 for pistons 45 to slide reciprocally therein, and a crankcase 47 for housing the crank webs 44. Each piston 45 is connected to the crankshaft 9 through a piston pin 56, a piston rod, and a crank pin 72.

The cylinder head 41 is formed with a combustion chamber 48 at the "top" of each cylinder 46, which is the rear end of the engine 8 when the crankshaft 9 of the engine 8 is disposed vertically. As shown in FIG. 4, an intake port 54 and an exhaust port 55 are formed facing each combustion chamber 48. An intake valve 49 and an exhaust valve 50 are provided in these ports 54,55 respectively.

An ignition plug 51 (FIG. 3) is provided at the top of each combustion chamber 48. Reference numeral 52 designates a cam shaft and reference numeral designates 53 a cam. A carburetor 57 can be provided in an intake pipe 59 in communication with the intake port 54. However, this is merely one type of fuel system that can be used with the engine 8. Direct and indirect fuel injection systems can also be used. An exhaust passage 58 is formed in communication with the exhaust port 55.

Coolant passages 60 are disposed around the combustion chambers 48, the cylinders 46, and the exhaust passages 58. The coolant passage 60 can be a single continuous coolant passage 60, or it can be divided into a plurality of individual passages.

In the illustrated embodiment, coolant (sea water) is drawn into the coolant pump 15 shown in FIGS. 1 and 2 and is pumped through the coolant passage 60. The gasket 43 provided on the mating face of the cylinder head 41 and cylinder body 40 and thus is exposed to the coolant passage 60 and the coolant.

Figure 5:
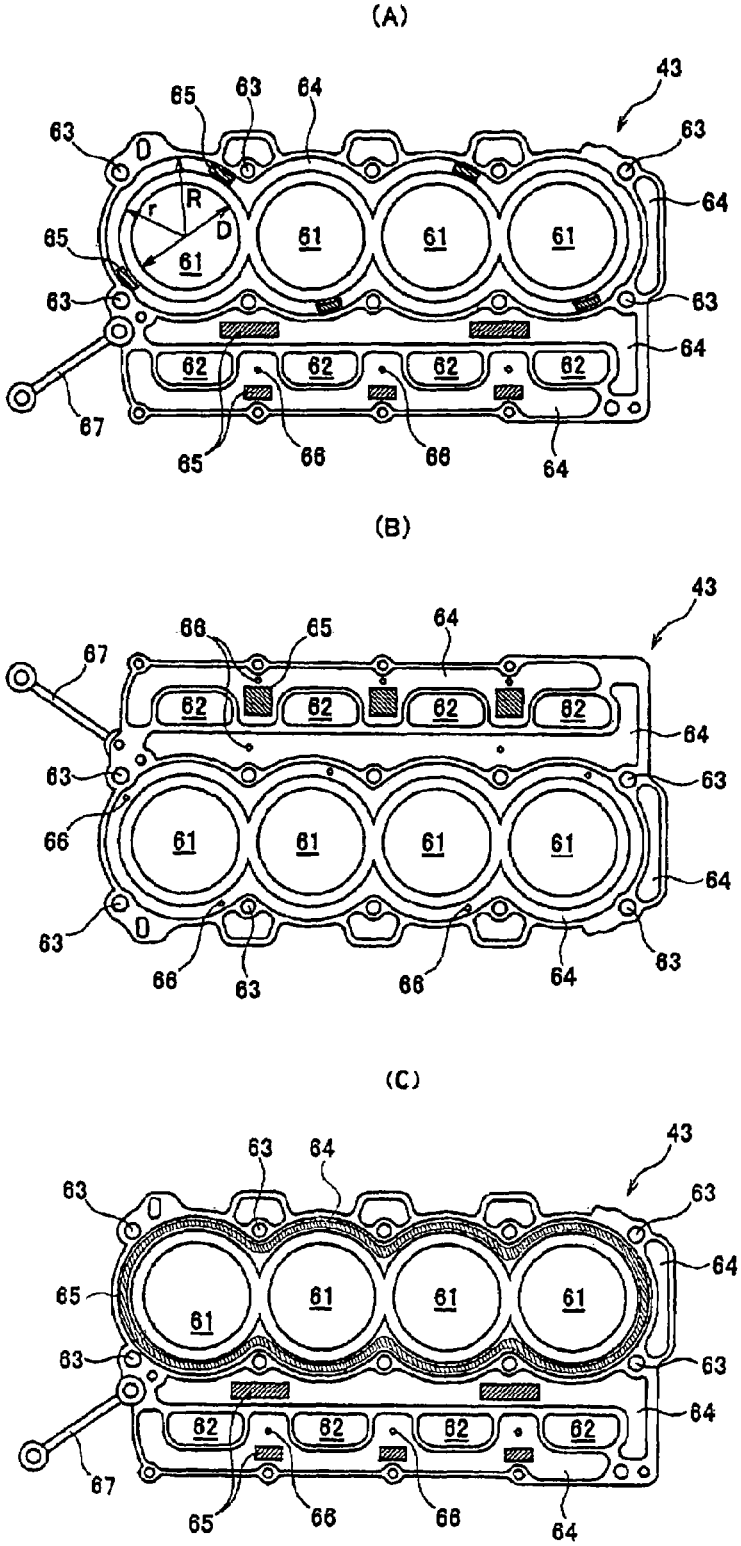
FIG. 5(A) is a rear elevational view of a gasket with anodes attached and constructed in accordance with an embodiment, the gasket being disposed on the engine and rotated ninety degrees clockwise and with the cylinder head removed.
FIG. 5(B) is a front elevational view of the gasket on the cylinder head, rotated ninety degrees clockwise, and removed from the engine.
FIG. 5(C) is a rear elevational view of a modification of the gasket disposed on the engine, rotated ninety degrees clockwise and with the cylinder head removed.

FIGS. 5(A) and 5(B) show a gasket according to an embodiment; FIG. 5(A) showing a gasket surface on the cylinder body side, and Figure (B) showing a gasket surface on the cylinder head side. The gasket, generally identified by the reference numeral 43, can include openings 61 corresponding to the four cylinders, and openings 62 corresponding to the exhaust passages 58. Additional openings can be provided for head bolts. For example, the illustrated embodiment includes ten through holes 63, disposed around the openings 61 for the cylinders, for accommodating head bolts that connect the cylinder body 40 and cylinder head 41.

Around the openings 61, 62 for the cylinders and exhaust passages is formed a coolant passage 64 corresponding to the foregoing coolant passage 60 (FIGS. 3 and 4) of the cylinder head 41 and cylinder body 40. In this embodiment, the inside diameter D of the opening 61 of each cylinder is about 80 mm, the radius R of the outer edge of the coolant passage 64 around a cylinder is about 57 mm, and the radius r of the inner edge is about 47 mm.

As shown in FIG. 5(A), five anodes 65 for electrolytic corrosion prevention (sacrificial anodes) are disposed on the surface on the cylinder body side of the coolant passage 64 around the cylinders. Other numbers of anodes 65 can also be used. The anodes can be made of a zinc material, or other materials. The anodes 65 can be fixed with bolts passing through mounting holes 66 at five corresponding locations in the gasket 43 (FIG. 5(B)).

Alternatively, the anode(s) 65 can be in other shapes. For example, as shown in FIG. 5(C), an anode for electrolytic corrosion prevention (sacrificial anode) 65 made of a zinc material is formed in a continuous, integrated shape surrounding the periphery of the cylinders. In this embodiment, the anode 65 can be attached to the gasket 43, as shown in FIG. 5(C). The anode 65 can be fixed with bolts (not shown) passing through the mounting holes 66 provided at the five locations in the gasket 43, as shown in Figure (B).

Such a continuous anode can be made by, for example, punching a sheet metal, bending a narrow plate material, or bending a wire material. Where the anode 65 is made of a sheet metal, a continuous plate-like anode 65 can have for example, a width of about 8 mm and a thickness of about 3 mm. In this embodiment, the anode 65 can be attached to the gasket with screws (bolts) at a plurality of locations.

In an embodiment where the anode 65 is made of a wire material, a wire material can be bent into the shape corresponding to the coolant passage 64. In an exemplary but non-limiting embodiment, a wire material of, for example, about 3 mm to about 5 mm diameter can be bent into the shape corresponding to the coolant passage 64 of the gasket surrounding the peripheries of the cylinders. A further advantage is achieved where the wire is pressed partially to form flat portions. Holes can be more easily formed in the flat portions, thereby simplifying the connection of the wire to the gasket 43 with screws or bolts. Such screws or bolts can be connected to the holes 66.

Such a continuous anode need not be continuous throughout the periphery of the cylinder head. Rather, the anode 65 can be separated at one location (if a bent wire material, a location where both ends of the wire material meet, for example) or at a plurality of locations. That is, even when a plurality of small separate anodes 65 of a long shape are disposed in series as shown in FIGS. 5(A)–5(B), the electrolytic corrosion prevention effect is also enhanced.

Using the same or similar techniques to those disclosed above, additional anode can be connected to the surface of the gasket 43 on the cylinder body side around thereof. For example, but without limitation, additional anodes 65 can be disposed in the exhaust passage openings 62, at two locations in the coolant passage 64 between the openings and the cylinders and at three locations near the outer edge. Optionally, three additional anodes 65 can be connected to the surface of the gasket 43 on the cylinder head side, as shown in FIG. 5(B).

An electric cord 67 can be connected to a peripheral edge of the gasket 43. The electric cord 67 can serve as means for establishing reliable electrical connection between the gasket 43 and the cylinder head or cylinder body. As such, a further advantage is achieved in providing a more reliable electrical connection, thereby further ensuring continued electrolytic corrosion prevention of the engine due to electrochemical reaction of the anode 65.

In the foregoing embodiments, the anode 65 is a sacrificial electrode attached to and protruding from the gasket 43 in the direction of its height into the coolant passage. The height of the anode can vary. In some embodiments, the height of the anode 65 is determined based on the depth or the shape of the coolant passage, or the total volume of anodes desired for electrolytic corrosion prevention.

As described above, since the shape and size of the anode 65 can be changed according to the structure of the coolant passages. This is advantageous because the coolant passages in different engines, thus the shape and size of the anode layout can be more easily optimized for each engine without the need to provide for machining of sacrificial anode seats in different orientations and/or spacings in the engine body. Additionally, the size of the anodes used can be varied without requiring engine body machining. For example, a large anode size anode can be used for an engine designed to have a long maintenance cycle; smaller anodes can be used for engines designed to have shorter maintenance cycles. Further, the time required for replacing an anode can be reduced. For example, the replacement of a gasket is a common repair for any type of internal combustion engine. Thus, anode replacement can be performed with the long and widely known procedure for replacing a gasket.

Figure 6:
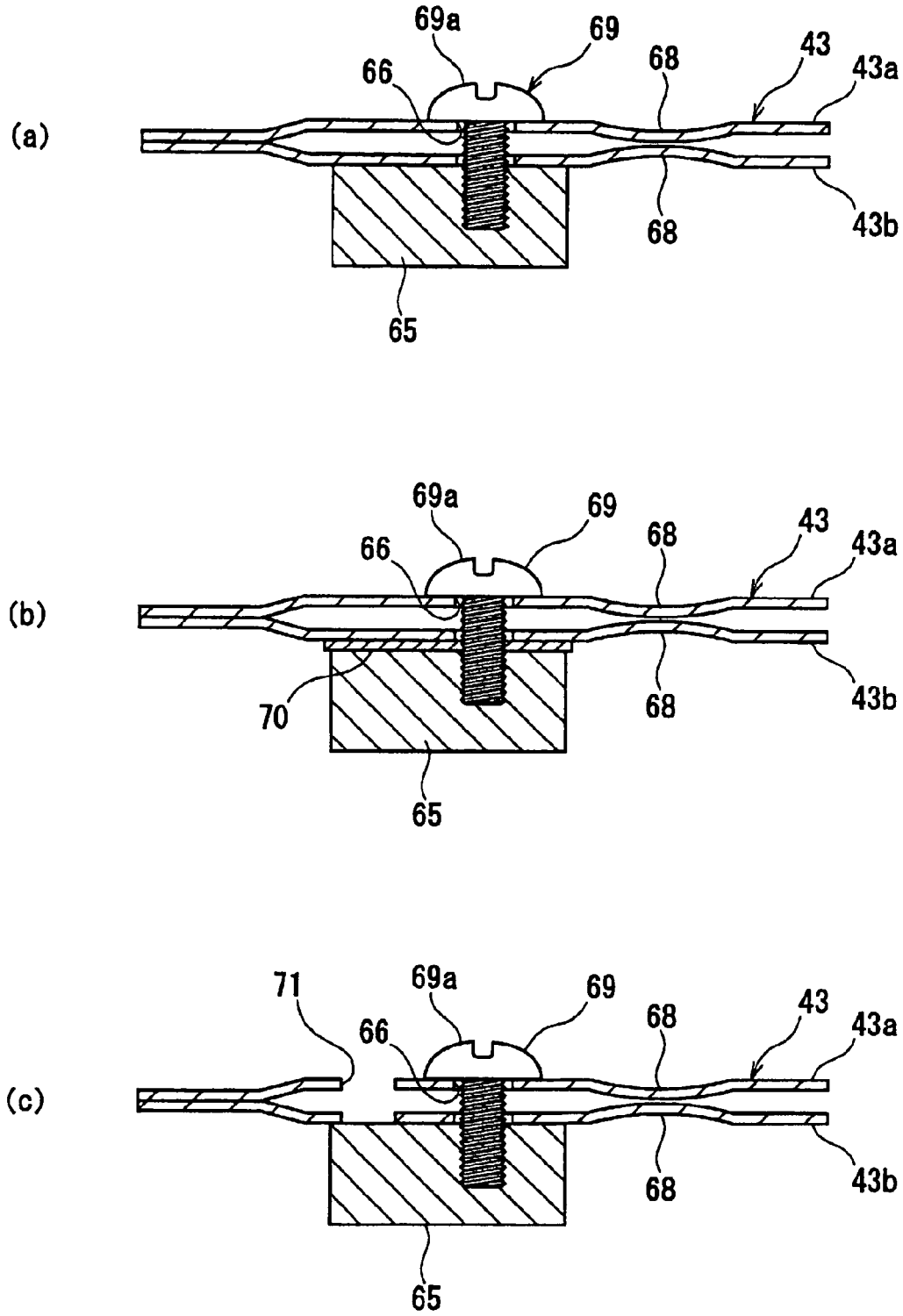
FIG. 6(*a*) is a partial sectional view of an exemplary mounting configuration for mounting the anode to the gasket.

FIGS. 6(*a*)–6(*c*) show different examples of an anode according to embodiments of this invention. In these examples, the gasket 43 is configured such that raised portions 68 of two stainless steel plates 43*a*, 43*b* are in abutment against each other for elasticity, and a coating is applied to the surface.

In the non-limiting example of FIG. 6(*a*), the anode 65 is fastened to one side of a gasket 43 with a screw 69 passing through a mounting hole 66 provided in the gasket 43. The anode 65 is formed with a screw hole (female thread) in advance. The coating of the stainless steel plate 43*a* in contact with the screw head 69*a* is removed so that electrical connection between the screw head 69*a* of the screw 69 and the gasket 43 is established. Such a coating can include the layer of chromium-oxide that naturally forms on the surface of stainless steel. The coating can be removed during machining of the mounting hole 66. For example, the drill used for drilling the mounting hole 66 can include, at its root, a blade, flange or other projections for scraping the surface of the gasket adjacent to the hole 66.

In the non-limiting example of FIG. 6(*b*), an insulating layer 70 is provided on the mounting surface of an anode 65, between the anode 65 and the gasket 43. Such an insulating layer 70 enhances reliable electrochemical reaction by the anode 65. Otherwise, the construction, effect, and function of this example are the same as in the example of FIG. 6(*a*).

In the non-limiting example FIG. 6(*c*), the gasket 43 is provided, at the mounting portion of an anode 65, with a communication hole 71. As such, the anode 65 is exposed to the opposite side of the mounting surface. Such a communication hole 71 allows the electrolytic corrosion prevention effect by the electrochemical reaction of the anode 65 to be produced also on the opposite side of the mounting surface, so that corrosion prevention of both the cylinder head and the cylinder body on both sides of the gasket can be effected by attaching the anode 65 to one side of the gasket 43. Otherwise, the construction, effect and function of this example are the same as in the example FIG. 6(*a*).

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above, but should be determined only by a fair reading of the claims that follow.

What is claimed is:

1. An anode mounting structure for a marine engine comprising a metallic gasket configured to be mounted between components of the engine formed with a coolant passage extending across the components, and an anode configured to prevent corrosion of the engine and disposed so as to face toward the coolant passage, wherein the anode is attached to the gasket.

2. The anode mounting structure according to claim 1, wherein an anode mounting hole is provided in the gasket, a screw hole is formed in the anode, and a screw is fitted into the screw hole of the anode through the anode mounting hole from an opposite side of an anode mounting surface, so as to fix the anode to the gasket.

3. The anode mounting structure according to claim 2, wherein a screw head of the screw and the gasket are electrically connected, and the gasket and components of the engine are electrically connected through an electric cord.

4. The anode mounting structure according to claim 1, wherein the anode is attached to a first side of the gasket, the gasket including a communication hole through which the anode is exposed to second side of the gasket, opposite the first side.

5. The anode mounting structure according to claim 1, wherein the anode has a continuous shape configured to surround a periphery of a cylinder head of the engine.

6. The anode mounting structure according to claim 1, in combination with an engine disposed in an outboard motor, the gasket being disposed between the components of the engine.

7. The anode mounting structure according to claim 1, wherein the gasket includes a coating, the coating being removed from the gasket at a location in the vicinity of the anode.

8. The anode mounting structure according to claim 7, wherein the gasket includes a hole and the anode is connected to the gasket with a fastener extending through the hole, the location being positioned adjacent to the hole such that the fastener contacts the location.

9. The anode mounting structure according to claim 1, wherein the engine components comprise a cylinder block and a cylinder head, the gasket being disposed between the cylinder block and the cylinder head.

10. The anode mounting structure according to claim 9, wherein the cooling passage extends into both the cylinder block and the cylinder head.

11. An anode mounting structure for a marine engine comprising a metallic gasket configured to be mounted between components of the engine formed with a coolant passage extending across the components, and an anode configured to prevent corrosion of the engine and disposed so as to face toward the coolant passage, and means for attaching the anode to an exterior of the gasket.

12. A marine engine comprising an engine body, the engine body including a first portion having a first mating face and a second portion having a second mating face, the first and second portions being removeably connected to each other with the first and second mating faces facing each other, a gasket disposed between the first and second mating faces, a cooling passage defined by at least one of the first and second portions, and at least one sacrificial anode connected to an exterior of the gasket so as to be exposed to fluid in the coolant passage.

13. The anode mounting structure according to claim 12, wherein the first portion is a cylinder block and the second portion is a cylinder head.

14. The anode mounting structure according to claim 12 additionally comprising an open loop cooling system including a water pump configured to pump water through the coolant passage.

* * * * *